United States Patent [19]

Lee

[11] Patent Number: 4,612,733

[45] Date of Patent: Sep. 23, 1986

[54] VERY HIGH SPEED LAP WITH POSITIVE LIFT EFFECT

[75] Inventor: Roger K. Lee, Watertown, Mass.

[73] Assignee: The United States of America as represented by the Secretary of the Air Force, Washington, D.C.

[21] Appl. No.: 720,937

[22] Filed: Apr. 8, 1985

[51] Int. Cl.[4] ..... B24B 7/24

[52] U.S. Cl. ..... 51/119; 51/109 R; 51/209 R; 51/283 R

[58] Field of Search ..... 51/71, 109 R, 119, 125, 51/209 R, 209 DL, 283 R, 330, DIG. 6; 29/81 R, 81 G, 81 J; 125/5

[56] References Cited

U.S. PATENT DOCUMENTS

| | | | |
|---|---|---|---|
| 843,624 | 2/1907 | Peirce . | |
| 1,979,689 | 11/1934 | Hoke | 51/278 |
| 2,065,942 | 12/1936 | Lane | 51/209 R |
| 2,270,691 | 1/1942 | Schneider | 51/209 |
| 2,412,306 | 12/1946 | Stoll | 51/119 |
| 2,776,527 | 1/1957 | Hoyet et al. | 51/209 DL |
| 2,820,334 | 1/1958 | Touvay | 51/209 |
| 4,019,289 | 4/1977 | Korver | 51/395 |

FOREIGN PATENT DOCUMENTS

| | | | |
|---|---|---|---|
| 59360 | 9/1982 | European Pat. Off. | 51/109 R |
| 2659438 | 7/1978 | Fed. Rep. of Germany | 51/209 R |
| 127657 | 8/1982 | Japan | 51/283 R |
| 422571 | 9/1974 | U.S.S.R. | 51/209 R |
| 1009724 | 4/1983 | U.S.S.R. | 51/283 R |

OTHER PUBLICATIONS

Article by A. A. Raimondi et al, p. 321 of Transactions of the American Society of Mechanical Engineers, 1956.

*Primary Examiner*—Robert P. Olszewski

*Attorney, Agent, or Firm*—Donald J. Singer; William G. Auton

[57] ABSTRACT

A rotary lapping system for grinding a workpiece in an abrasive slurry liquid and producing a positive lift in the abrasive slurry liquid is disclosed. The positive lift is the result of the particular mounting of the grinding pads which causes the leading edge pads to possess a positive angle of attack during rotation in the abrasive slurry liquid. The advantages of a positive lift in the grinding pads includes preventing the grinding tools from digging into the surface of the workpiece during very high speed lap grinding. Trailing edge grinding pads are allowed to produce, in one embodiment, a negative angle of attack which results in a negative lift. The net lift of all grinding pads may be a neutral lift, which allows the entire lap substrate to be tilted and allow working of local areas while the leading edge guiding pads continue to hydroplane over the workpiece surface and avoid tendencies to dig into the surface.

4 Claims, 8 Drawing Figures

5-MICROMETER PARTICLE GRIND-ETCHED 1.5-MICROMETER PARTICLE GRIND-ETCHED

VERY HIGH SPEED LAP WITH POSITIVE LIFT EFFECT

STATEMENT OF GOVERNMENT INTEREST

The invention described herein may be manufactured and used by or for the Government for governmental purposes without the payment of any royalty thereon.

BACKGROUND OF THE INVENTION

The present invention relates generally to abraiding through the use of rotary lapping systems, and is specifically directed to the use and configuration of grinding pads, called tesserae, which produce a positive lift effect in high speed lap grinding.

Future generations of orbiting telescopes used for astronomy, information collection and transmission, and power transmission will require very large segmented mirrors. The telescope designs will necessarily make use of highly aspheric mirrors.

While prior art rotary lapping systems are used to remove material from a variety of workpieces, prior art systems are not effective in producing large lightweight, odd-shaped, infrared quality aspheric mirrors, and other optical elements, which are manufactured through a succession of grinding and polishing with rotary lapping systems. A review of optical surfacing techniques indicates that two-thirds of the manufacturing time is spent polishing out subsurface damage from grinding.

There exists a need to process large sections of aspheric optical systems in a rapid and efficient manner. While optical surface tolerances are less difficult to meet in infrared systems, eventually the next generation of space telesopes will require quality suitability for visible-spectrum use.

In view of the foregoing discussion it is apparent that there currently exists the need for a rotary lapping system which has an ability to hydroplane above a work surface on the abrasive slurry liquid, to effectively, grind, aspheric workpieces. The present invention is directed towards satisfying that need.

SUMMARY OF THE INVENTION

The present invention relates to abraiding and is specifically directed to the construction of grinding pads called tesserae to produce a positive lift effect in high speed lap grinding. The rotary lapping system of the present invention uses a plurality of positive lift tools, each of which is composed of a square base of metal, a rubber sheet bonded to the base and four brass tessera bonded to the rubber sheet. Each tessera has a plurality of equally spaced, parallel grooves forming the grinding surface and the four tesserae are bonded to the rubber sheet to leave a relatively wide space, or slot, between each of the tessera. The pads in groups of four are attached around the outer edge of a metal ring which is bonded to the base of a power driven dish-like member for holding a grinding slurry to be fed to the grinding surfaces. The tessera construction causes a positive lift in which the leading edge tesserae hydroplane above the work surface on the abrasive slurry liquid with the weight of the tool providing the working pressure required on the abrasive, to cause removal of material from the workpiece. The present invention was developed in conjunction with another by the same inventor entitled "High Speed Lap with Negative Lift Effect", U.S. Pat. Ser. No. 720,936, filed Apr. 8, 1985, and incorporated herein by reference.

The tesserae mounting of the present invention differs from the above-referenced invention in that the rubber layer of the present invention, to which the brass tesserae are bonded, extends into and substantially fills the slots between the tesserae. The rotary movement of the lapping tool results in a positive angle of attack, by the leading edge tesserae, which, in turn, results in a positive lift effect.

It is a principal object of the invention to present a rotary lapping system capable of grinding and polishing, aspheric workpieces in a rapid and efficient manner.

It is another object of the present invention to minimize subsurface damage when grinding thin workpieces. Because of the positive lift effect, it is possible to apply moments to the tool via the drive ring. The moments cause the tool to remove material more on one side because of increased pressure. [This is not practical with negative lift tools because the suction force overwhealms any attempt to perform locally controlled material removal by externally applied moments.]

It is another object of the present invention to present a rotary lapping system which produces a positive lift, between the tool and workpiece, which enables the tool to hydroplane on the abrasive slurry liquid above the workpiece.

These together with other objects features and advantages of the invention will become more readily apparent from the following detailed description when taken in conjunction with the accompanying drawings wherein like elements are given like reference numerals throughout.

DETAILED DESCRIPTION OF THE PREFERRED EMBODIMENT

The present invention includes the configuration and use of grinding pads called tesserae, which produce a positive lift effect in high speed lap grinding.

Figure 1:
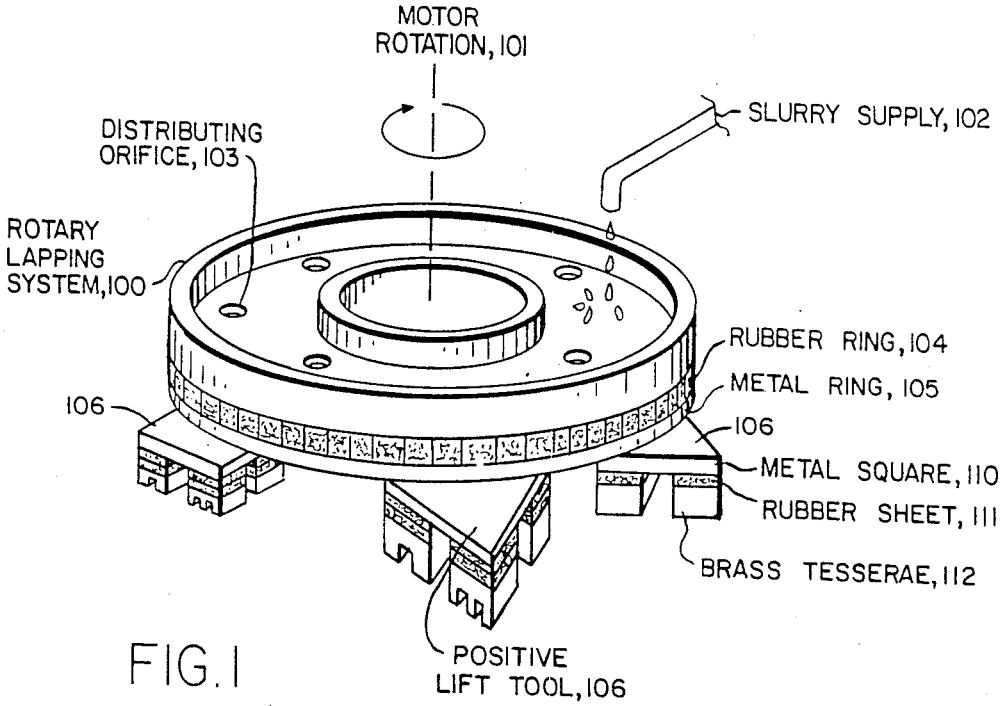
FIG. 1 is a sketch of the rotary lapping system of the present invention.

FIG. 1 is a block diagram of a rotary lapping system 100, of the present invention, which removes material from workpiece using a liquid abrasive slurry. The rotary lapping system 100 is used to grind or polish workpieces using a motor rotation 101 and liquid abrasive slurry from a slurry supply 102.

In the embodiment depicted in FIG. 1, the liquid abrasive slurry falls on the surface of the workpiece through a plurality of distributing orifices 103. The grinding is accomplished by the movement of a plurality of positive lift tools 106, each of which are equally spaced from each other, and attached around the outer edge of a metal ring 105, which is fixed to a rubber ring 104 which is bonded to the base of the power driven dish-like member of the rotary lapping sytem.

Figure 2A:
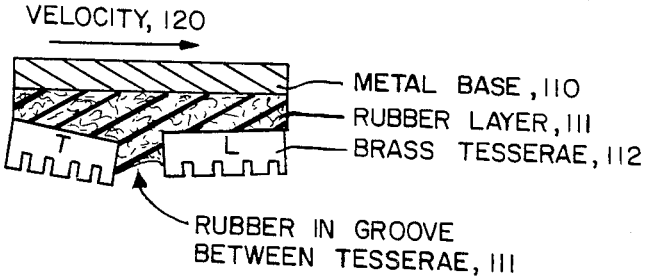
FIG. 2*a* and 2*b* are two views of the positive lift tools of the present invention.
Figure 2B:
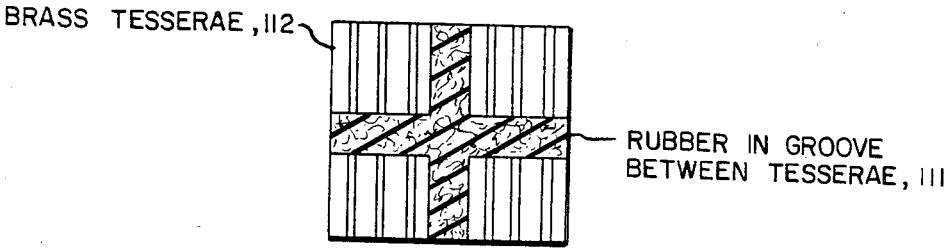

FIGS. 2*a* and 2*b* are alternative perspective views of a single positive lift tool 106 of FIG. 1. The configuration of the lap tesserae mounting in each positive lift tool 106 is responsible for the positive lift created with the use of the present invention. The way the mounting produces this positive lift by rotating the tesserae outwards is described in detail below.

FIGS. 2*a* and 2*b* depict four brass tesserae 112, each bonded to the rubber layer 111, which extends into and substantially fills the slots between the tesserae. The rubber layer 111 is, in turn, bonded to the single square base of metal 110 which is fixed to the metal ring 105 of the rotary lapping system 100 of FIG. 1.

This mounting configuration results in a comparatively stiff center support area compared to the outer edge. This stiff center section causes the leading edge tesserae to assume a positive angle of attack during rotation of the lift tool; and trailing edge tesserae to assume a negative angle of attack, since the mounting only allows the tesserae to rotate outwardly. The positive angle of attack of the leading edge tesserae produces a positive lift through hydrodynamic interaction with the abrasive slurry liquid, just as the trailing edge tesserae produce a negative lift. The net moment on the lift tool can cause it to assume a positive angle of attack, if it is flexibly mounted.

Each tesserae has a plurality of equally spaced, parallel grooves forming its grinding surface, but it is the configuration of the lap terrerae mounting that is responsible for the production of the positive lift when using the invention. Because the rubber is confined between the inner boundaries of the tessarae, and is unconfined with a free boundary around the perimeter, the local stiffness in the middle of the group of 4 tessarae is higher than the stiffness at the corner locations of the boundary. Therefore, under the hydrodynamic loading of the tessarae caused by tool motion, the leading pair of tessarae assume a positive load bearing attitude of the classical slider bearing of the pivoted shoe type (e.g., Kingsbury) which then support the weight of the tool for cutting in a controlled manner.

Figure 3:
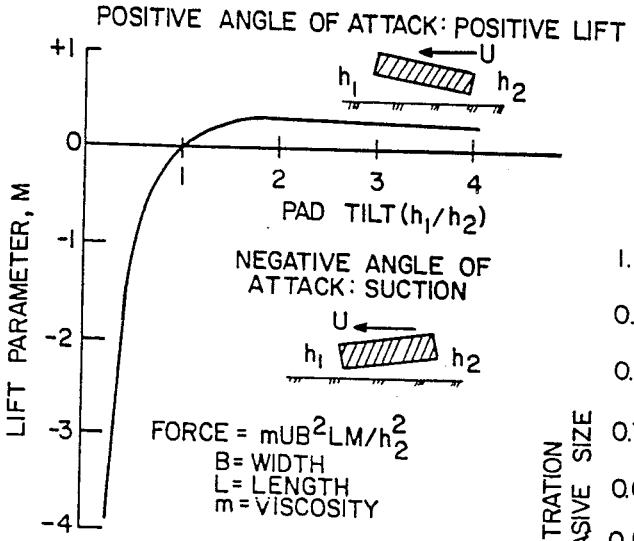
FIG. 3 is a chart depicting the performance of a tilting pad bearing.

FIG. 3 is a chart depicting the performance of a tilting pad bearing. FIG. 3 indicates the entire response of a tilting pad, such as the tesserae 112 of FIGS. 2*a* and 2*b*, for both positive and negative angles of attack.

The tesserae mounting configuration shown in FIGS. 2*a* and 2*b* produce a positive angle of attack in leading edge tesserae when each tesserae 112 is moved with the velocity 120 during rotary lapping. The tool tessarae are capable of tilting in two directions so that they can align themselves with respect to aspheric workpiece surfaces whose relative slope changes as the tool goes around. FIG. 3 indicates that with the positive angle of attack, the lift forces of the leading edge tesserae in the rotary lapping system combine to produce a positive lift effect, and hydroplane over the surface of the workpiece. The trailing edge tesserae produce a negative angle of attack which results in a suction between them and the workpiece. While the net lift may be one of neutral lift, the act of having the leading edge hydroplane helps the lift tools avoid any tendencies to dig into the surface of the workpiece. Additionally, a net neutral lift allows the entire lap substrate to be tilted if a localized shift in the pressure gradient is desired.

In the preferred embodiment, the slurry type used with this tool consists of 0.1 percent polyethylene oxide ($4\times10^6$ molecular weight), 2 percent of 1 to 2 micrometer diamond powder, 1 percent water soluble oil, and balance of distilled water; the linear speed of the tessarae is about 6.6 inches per second.

The selection of the above slurry type was made after empirically determining relative abrasive removal rates using a 12-pound ring tool of 75 square inches running at 120 RPM.

Figure 4:
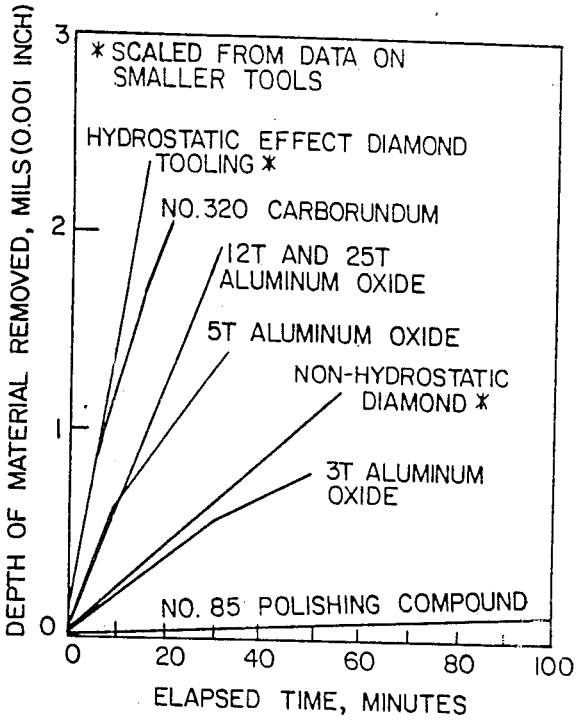
FIG. 4 is a chart depicting relative abrasive removal rates.

Data was collected using a Pyrex-faced rotating lap on Pyrex and fused silica blanks. Typical results are shown in FIG. 4. The cause of the slowness of the polishing operation becomes evident from these grinding rate curves; the finest abrasive it was found that one could use in this system was 5T aluminum oxide. The 3T aluminum oxide was tried, but produced a poor surface finish with sleeks and scratches, confirming normal optical workshop experience. To remove the damaged layer produced by 5T aluminum oxide abrasive, it would be necessary to polish away about $0.6\times10^{-3}$ inch of material. Beacuse of missing useful abrasive particle sizes, the relatively ineffective operation was prolonged. Aluminum oxide particle strength decreases with particle size, becoming weaker than fused silica at around the 3-micrometer diameter. In order to get a useful smaller abrasive particle, one would need one that was stronger, like silicon carbide or diamond. After a brief study of different sources for abrasives, it was determined that synthetic diamonds were the cheapest and most consistently graded for size.

Figure 5:
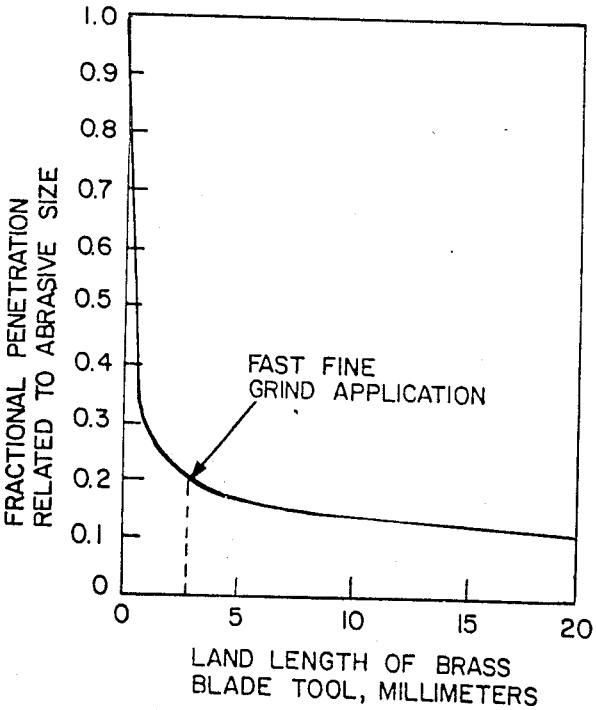
FIG. 5 is a chart depicting tool land versus fractional penetration or debris size as a fraction of the abrasive particle size for 2 micrometer size diamonds.

A seizing effect occurs when the interface between the lapping tool and the workpiece becomes clogged with swarf from the grinding operation. The seizing effect, suggests that one could compute the rate at which the tool-to-work interface filled up with swarf, and that the land length of the tool could be adjusted to that it was less than the path of travel needed to clog the tool. Assuming that the diamonds were 2.0 micrometer tetrahedrons rolling in the interface, the land length could be related to two parameters—the initial diamond concentration and the size of the debris particle produced. FIG. 5 shows the result of such an estimate using a typical diamond concentration solution of 5 percent; the land length is plotted against the debris size expressed as a fraction of the size of the abrasive particle, which by experience seems to be relatively constant for abrasive processes. By inference, for simple fractures, this fraction should be comparable to the depth of surface finish as well. Therefore, by measurement of the surface profiles, this fraction was found to be about 0.2, giving a land length of 4 millimeters. The tapered-form tools were accordingly slotted in the axial direction at a 4-millimeter pitch, and the resulting surface finishes were dramatically improved. Furthermore, in spite of the unidirectional tool motion, the surfaces produced were completely random in surface texture on a microscopic scale, being as perfectly found as any conventionally produced ground surface.

Figure 6A:
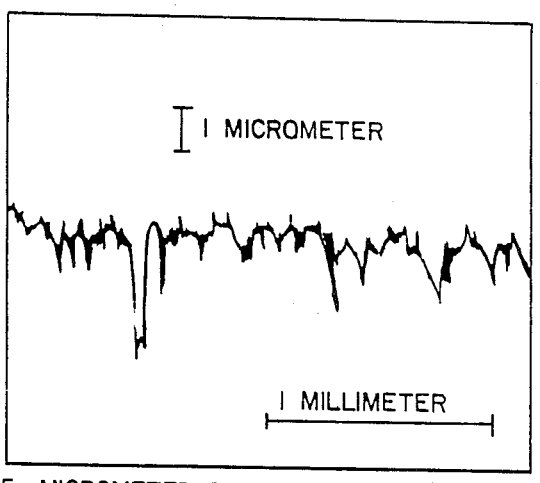
FIGS. 6*a* and 6*b* depict a comparison of 5 micrometer, and 1.5 micrometer particle grinds.
Figure 6B:
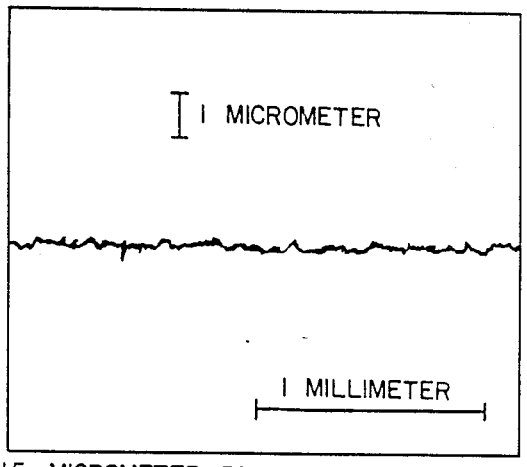

FIGS. 6*a* and 6*b* show the resulting surface finishes for 5-micrometer and 1,5-micrometer abrasives. The graph is a trace from the Dektac instrument from the surfaces that have been etched to reveal their extent of subsurface damage. This type of ground surface has been characterized at Itek by the catch name "fast fine grind". The surface is sufficiently fine so that good contrast interference fringes can be obtained from it, thus facilitating optical testing without needing to use waxing or long-wavelength interferometers.

The preferred embodiment of the present invention entails its use with another invention that was developed in conjunction with it. This other invention is entitled "Computer Controlled Optical Surfacing (CCOS) Lap Pressure Control Concept" by Allen H. Greenleaf, the U.S. Pat. Ser. No. 777,141, filed Sept. 18, 1985, and the disclosure of which is incorporated herein by reference.

The Greenleaf invention combines the present invention with a means of controlling lap pressure, including the application of moments to the lapping pads. On the Greenleaf invention, each pad has an upwardly extending stem mounted in a slot or notch, in a rotary control plate by springs that cause tipping of the pads to produce the desired hydrodynamic effect.

While the invention has been described in its presently preferred embodiment it is understood that the words which have been used are words of description rather than words of limitation and that changes within the purview of the appended claims may be made without departing from the scope and spirit of the invention in its broader aspects.

What is claimed is:

1. A rotary lapping system capable of grinding and polishing a workpiece using an abrasive slurry liquid, said rotary lapping system avoiding any tendencies to dig into the workpiece by generating a positive lift in its leading edge grinding surfaces causing them to hydroplane above the workpiece through hydrodynamic action with the abrasive slurry liquid, said rotary lapping system comprising:

a supply of the abrasive slurry liquid, which is applied to the workpiece;

a rotary means;

a dish member connected to and being rotated by said rotary means; and a plurality of positive lift tools, each fixed beneath an outer edge of said dish member and producing said positive lift by presenting leading edge surfaces with a positive angle of attack in said abrasive slurry liquid, said leading edge surfaces generating a positive lift through hydrodynamic interaction with said abrasive slurry liquid, each of said plurality of positive lift tools presenting a grinding surface to said workpiece which, when rotated in said abrasive slurry liquid from said supply, is used to grind said workpiece.

2. A rotary lapping system, as defined in claim 1, wherein each of said plurality of positive lift tools comprises:

a base which is fixed beneath the outer edge of the dish member;

a plurality of leading edge tesserae, each presenting a grinding surface towards the workpiece and a positive angle of attack in said abrasive slurry liquid when said positive lift tool is rotated, said positive angle of attack causing said positive lift; and a flexible mounting means which attaches each of said plurality of tesserae to the base, said flexible mounting means causing each leading edge tesserae to present a positive angle of attack in said abrasive slurry liquid when said positive lift tool is rotated.

3. A rotary lapping system, as defined in claim 2, wherein each of said plurality of leading edge tesserae each comprise a rectangular metal block having a plurality of equally spaced, parallel grooves forming its guiding surface at its bottom area, each of said plurality of tesserae having its top attached to said flexible mounting means.

4. A rotary lapping system, as defined in claim 3, wherein each of said flexible mounting means comprises a flexible pad having its top surface bonded to said base, and its bottom surface bonded to a plurality of tesserae around its perimeter, each of said tesserae being separated from each other by a space, and each space being substantially filled by a flexible layer extended from said flexible pad causing a local stiffness in the middle of the plurality of leading edge tesserae, said local stiffness causing all leading edge tesserae to have a positive angle of attack in said abrasive slurry liquid during rotation, said positive angle of attack in said abrasive slurry liquid resulting in said positive lift in each positive lift tool.

* * * * *